US011078588B2

(12) United States Patent
Martel et al.

(10) Patent No.: US 11,078,588 B2
(45) Date of Patent: Aug. 3, 2021

(54) PULSE PLATED ABRASIVE GRIT

(71) Applicant: United Technologies Corporation, Farmington, CT (US)

(72) Inventors: Nathan T. Martel, Glastonbury, CT (US); Thomas R. Hanlon, Colchester, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 410 days.

(21) Appl. No.: 15/401,579

(22) Filed: Jan. 9, 2017

(65) Prior Publication Data

US 2018/0195192 A1 Jul. 12, 2018

(51) Int. Cl.

| | |
|---|---|
| ***C25D 5/18*** | (2006.01) |
| ***C25D 7/00*** | (2006.01) |
| ***C25D 15/00*** | (2006.01) |
| ***C25D 5/50*** | (2006.01) |
| ***C25D 15/02*** | (2006.01) |
| ***C25D 5/34*** | (2006.01) |
| ***C25D 5/14*** | (2006.01) |
| ***F01D 5/14*** | (2006.01) |
| ***F01D 5/28*** | (2006.01) |
| ***F01D 11/12*** | (2006.01) |

(52) U.S. Cl.

CPC ..... *C25D 5/18* (2013.01); *C25D 5/34* (2013.01); *C25D 5/50* (2013.01); *C25D 7/00* (2013.01); *C25D 15/00* (2013.01); *C25D 15/02* (2013.01); *F01D 5/147* (2013.01); *F01D 5/288* (2013.01); *F01D 11/122* (2013.01); *C25D 5/14* (2013.01); *F05D 2220/32* (2013.01); *F05D 2230/31* (2013.01); *F05D 2240/307* (2013.01); *F05D 2240/31* (2013.01); *F05D 2300/2282* (2013.01); *F05D 2300/6032* (2013.01)

(58) Field of Classification Search

CPC . C25D 5/18; C25D 13/18; C25D 5/02; C25D 15/02

See application file for complete search history.

(56) References Cited

U.S. PATENT DOCUMENTS

| | | | | |
|---|---|---|---|---|
| 5,076,897 A * | 12/1991 | Wride | B24D 99/00 205/110 |
| 5,603,603 A | 2/1997 | Benoit et al. | |
| 5,702,574 A * | 12/1997 | Foster | C25D 5/02 118/500 |
| 5,879,753 A | 3/1999 | Zajchowski et al. | |
| 5,935,407 A | 8/1999 | Nenov et al. | |
| 6,190,124 B1 | 2/2001 | Freling et al. | |
| 6,355,086 B2 | 3/2002 | Brown et al. | |

(Continued)

OTHER PUBLICATIONS

Osero, N. M., "An Overview of Pulse Plating", Plating and Surface Finishing, (1986), pp. 20-22. http://www.praxairsurfacetechnologies.com/coating-services/application-processes/plating.

(Continued)

*Primary Examiner* — Brian W Cohen

(74) *Attorney, Agent, or Firm* — Bachman & LaPointe, P.C.

(57) ABSTRACT

A method for forming an abrasive surface includes applying an electric current through a plating solution so as to cause an abrasive grit to be deposited onto a workpiece and varying a waveform of the electric current while building up a matrix material at least partially around the abrasive grit.

7 Claims, 7 Drawing Sheets

(56) References Cited

U.S. PATENT DOCUMENTS 6,502,304 B2 1/2003 Rigney et al.
6,610,416 B2 8/2003 Wallace et al.
6,616,410 B2 9/2003 Grylls et al.
6,699,379 B1 * 3/2004 Ke ..... C25D 3/562 205/109
6,916,529 B2 7/2005 Pabla et al.
6,984,107 B2 1/2006 Grunke et al.
7,425,115 B2 9/2008 Johnson et al.
7,435,056 B2 10/2008 Liston
7,448,843 B2 11/2008 Pilecki, Jr.
7,836,593 B2 11/2010 Allen
7,918,460 B2 4/2011 Ochiai et al.
7,922,455 B2 4/2011 Itzel et al.
8,122,600 B2 2/2012 Kinstler et al.
8,172,518 B2 5/2012 Ruehr et al.
8,236,163 B2 8/2012 Garimella et al.
8,657,570 B2 2/2014 Kray et al.
8,662,834 B2 3/2014 Kray et al.
8,807,955 B2 8/2014 Wrabel et al.
9,145,775 B2 9/2015 Levine et al.
9,186,816 B2 * 11/2015 Tian ..... B23D 61/185
9,187,831 B2 11/2015 Ochiai et al.
9,284,647 B2 3/2016 Ochiai et al.
9,341,066 B2 5/2016 Bintz et al.
2001/0037944 A1 * 11/2001 Sanada ..... C25D 17/20 205/143
2004/0208749 A1 10/2004 Torigoe et al.
2005/0121332 A1 * 6/2005 Kochilla ..... C25D 9/08 205/316
2011/0186439 A1 * 8/2011 Linska ..... C25D 17/004 205/109
2011/0256356 A1 * 10/2011 Tomantschger ..... C25D 1/00 428/172
2016/0237581 A1 * 8/2016 Foster ..... C22C 19/057
2017/0297673 A1 * 10/2017 Rice ..... C23C 30/00

OTHER PUBLICATIONS

Kasturibai, S. et al; "Pulse Electrodeposition and Corrosion Properties of Ni—Si3—N4 Nanocomposite Coatings"; Bulletin of Materials Science, vol. 37, No. 3, May 2014 (May 2014), pp. 721-728, Indian Academy of Sciences.

European Search Report dated May 8, 2018 for corresponding European Patent Application No. 18150744.3.

* cited by examiner

PULSE PLATED ABRASIVE GRIT

BACKGROUND

The present disclosure relates to a method for applying electroplated coatings, and more specifically to a method for applying abrasive grit to gas turbine airfoil blade tips via pulse plating.

Oftentimes, a gas turbine blade tip includes a coating with abrasive particles embedded in a matrix, the tip being intended to run against the surface of a shroud of a material which is softer than the abrasive particles. The codeposition of matrix material and particles is typically accomplished from an electrodeposition bath in which there are suspended abrasive particles formed from aluminum oxide, cubic boron nitride (CBN), or other abrasive carbides, oxides, silicides, or nitrides.

Although effective, the electrolytic application of the CBN abrasive may result in a fatigue life reduction to allow the airfoils to withstand interactions with abradable air seals, but could benefit from increased wear resistance and fatigue strengthening.

SUMMARY

A method for forming an abrasive surface according to one disclosed non-limiting embodiment of the present disclosure can include applying an electric current through a plating solution so as to cause an abrasive grit to be deposited onto a workpiece; and varying a waveform of the electric current while building up a matrix material at least partially around the abrasive grit.

A further embodiment of the present disclosure may include that the abrasive grit includes cubic boron nitride (CBN).

A further embodiment of the present disclosure may include that varying the waveform includes pulse reverse current plating.

A further embodiment of the present disclosure may include performing a low bake for bond optimization after build-up of the matrix material around the grit A further embodiment of the present disclosure may include building up the matrix material around the abrasive grit with pulsed current nickel plating.

A further embodiment of the present disclosure may include that building up the matrix material around the abrasive grit includes building up a nickel layer.

A further embodiment of the present disclosure may include performing a bake for stress relief subsequent to building up the matrix material around the abrasive grit.

A further embodiment of the present disclosure may include that varying the waveform of the electric current includes pulsing of the electric current to cause new nucleation of nickel crystals.

A further embodiment of the present disclosure may include that the workpiece is a rotor blade.

A further embodiment of the present disclosure may include that the workpiece is a tip of a rotor blade.

A method for forming an abrasive surface according to one disclosed non-limiting embodiment of the present disclosure can include pulse plating a workpiece to build up a matrix material around an abrasive grit.

A further embodiment of the present disclosure may include that the abrasive grit includes cubic boron nitride (CBN).

A further embodiment of the present disclosure may include that the pulse plating causes new nucleation of nickel crystals.

A further embodiment of the present disclosure may include that the pulse plating includes tacking on the abrasive grit.

A further embodiment of the present disclosure may include that the pulse plating includes building up a nickel layer as the matrix material around the abrasive grit.

A further embodiment of the present disclosure may include performing a bake for stress relief subsequent to building up the matrix material around the abrasive grit.

A rotor blade according to one disclosed non-limiting embodiment of the present disclosure can include an abrader that includes an abrasive grit with a grain size between 10-100 nm and a hardness between 250-400 HV.

A further embodiment of the present disclosure may include that rotor blade is a turbine blade.

A further embodiment of the present disclosure may include that the abrader is applied to a tip of the rotor blade.

A further embodiment of the present disclosure may include that the abrasive grit includes cubic boron nitride (CBN) that is pulse plated on the tip of the rotor blade.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
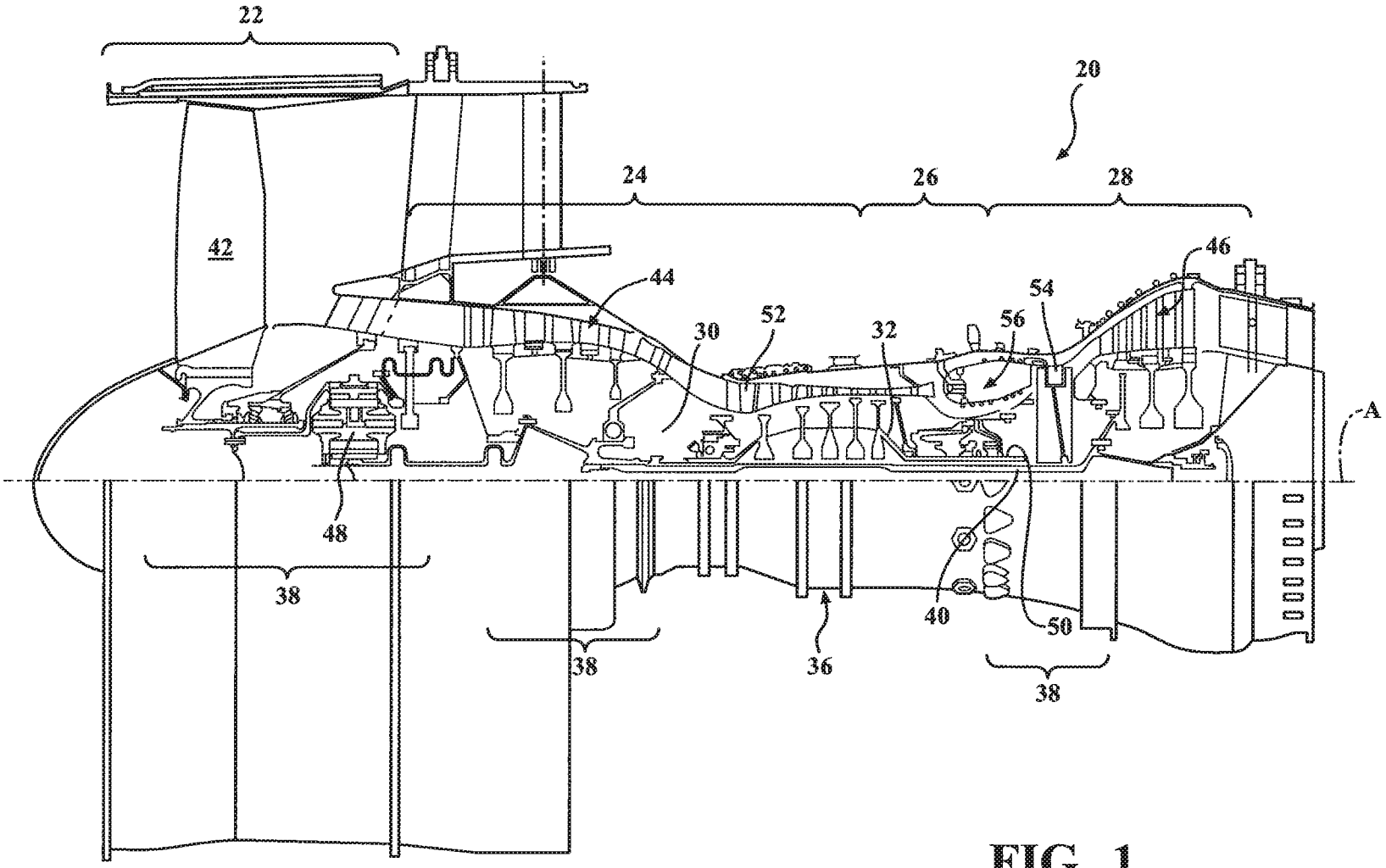
FIG. 1 is a schematic cross-section of an example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, the concepts described herein are not limited to use with turbofans as the teachings may be applied to other types of turbine engine architectures such as turbojets, turboshafts, and three-spool (plus fan) turbofans.

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor (LPC) 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor (HPC) 52 and high pressure turbine (HPT) 54. A combustor 56 is arranged between the HPC 52 and the HPT 54. The inner shaft 40 and the outer shaft 50 are concentric and rotate about the engine central longitudinal axis A.

Core airflow is compressed by the LPC 44 then the HPC 52, mixed with the fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by bearing structures 38 within the static structure 36. Various bearing structures 38 at various locations may alternatively or additionally be provided.

Figure 2:
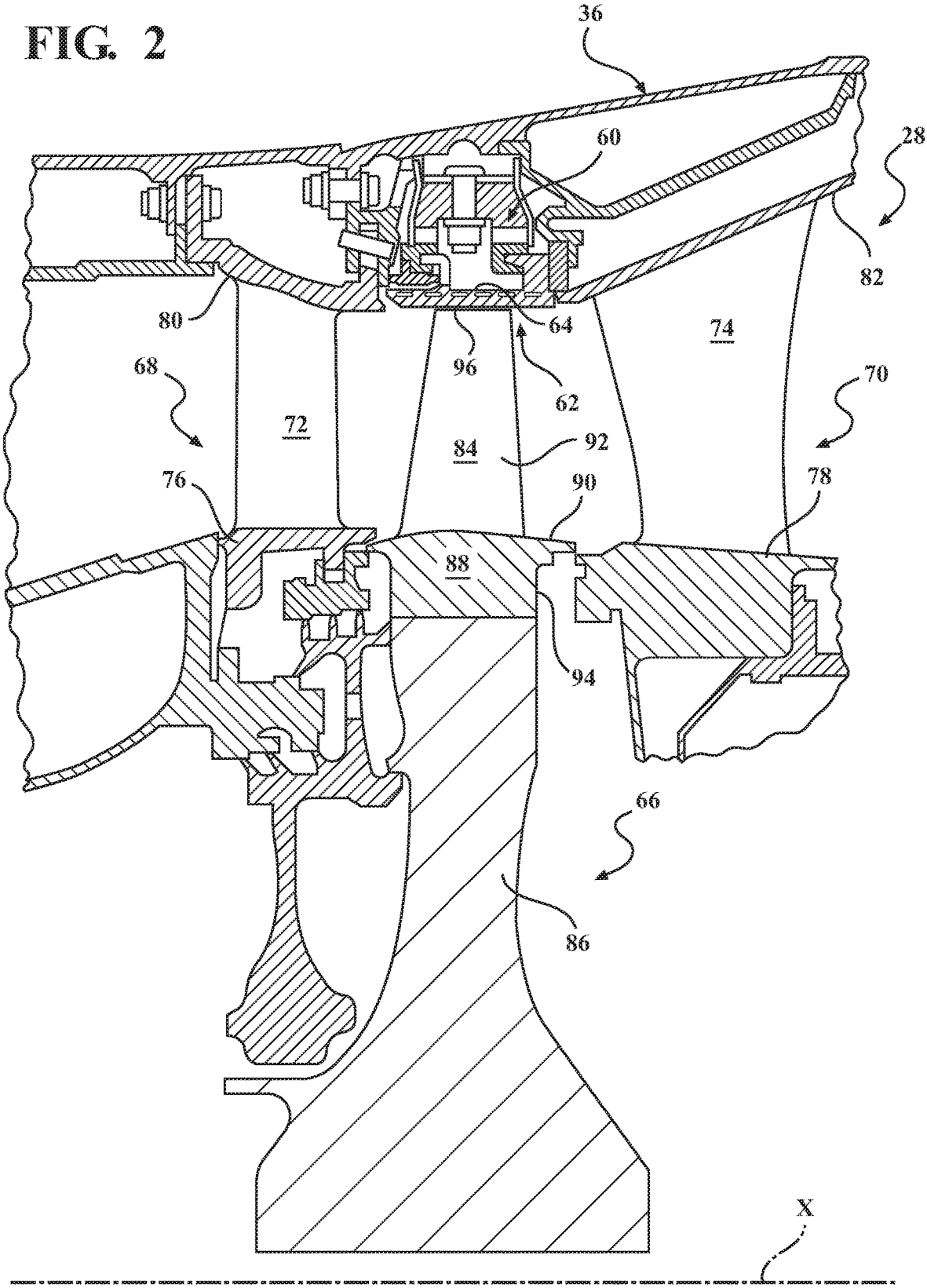
FIG. 2 is an enlarged schematic cross-section of an engine turbine section.

With reference to FIG. 2, an enlarged schematic view of a portion of the turbine section 28 is shown by way of example. A full ring shroud assembly 60 within the engine case structure 36 supports a blade outer air seal (BOAS) assembly 62 with a multiple of circumferentially distributed BOAS segments 64 proximate to a rotor assembly 66 (one segment schematically shown).

The full ring shroud assembly 60 and the BOAS assembly 62 are axially disposed between a forward stationary vane ring 68 and an aft stationary vane ring 70. Each vane ring 68, 70 include an array of vanes 72, 74 that extend between a respective inner vane platform 76, 78 and an outer vane platform 80, 82. The outer vane platforms 80, 82 are attached to the engine case structure 36.

The rotor assembly 66 includes an array of blades 84 circumferentially disposed around a disk 86. Each blade 84 includes a root 88, a platform 90 and an airfoil 92 (also shown in FIG. 3). The blade roots 88 are received within a rim 94 of the disk 86 and the airfoils 92 extend radially outward such that a tip 96 of each airfoil 92 is closest to the blade outer air seal (BOAS) assembly 62. The platform 90 separates a gas path side inclusive of the airfoil 92 and a non-gas path side inclusive of the root 88.

Figure 3:
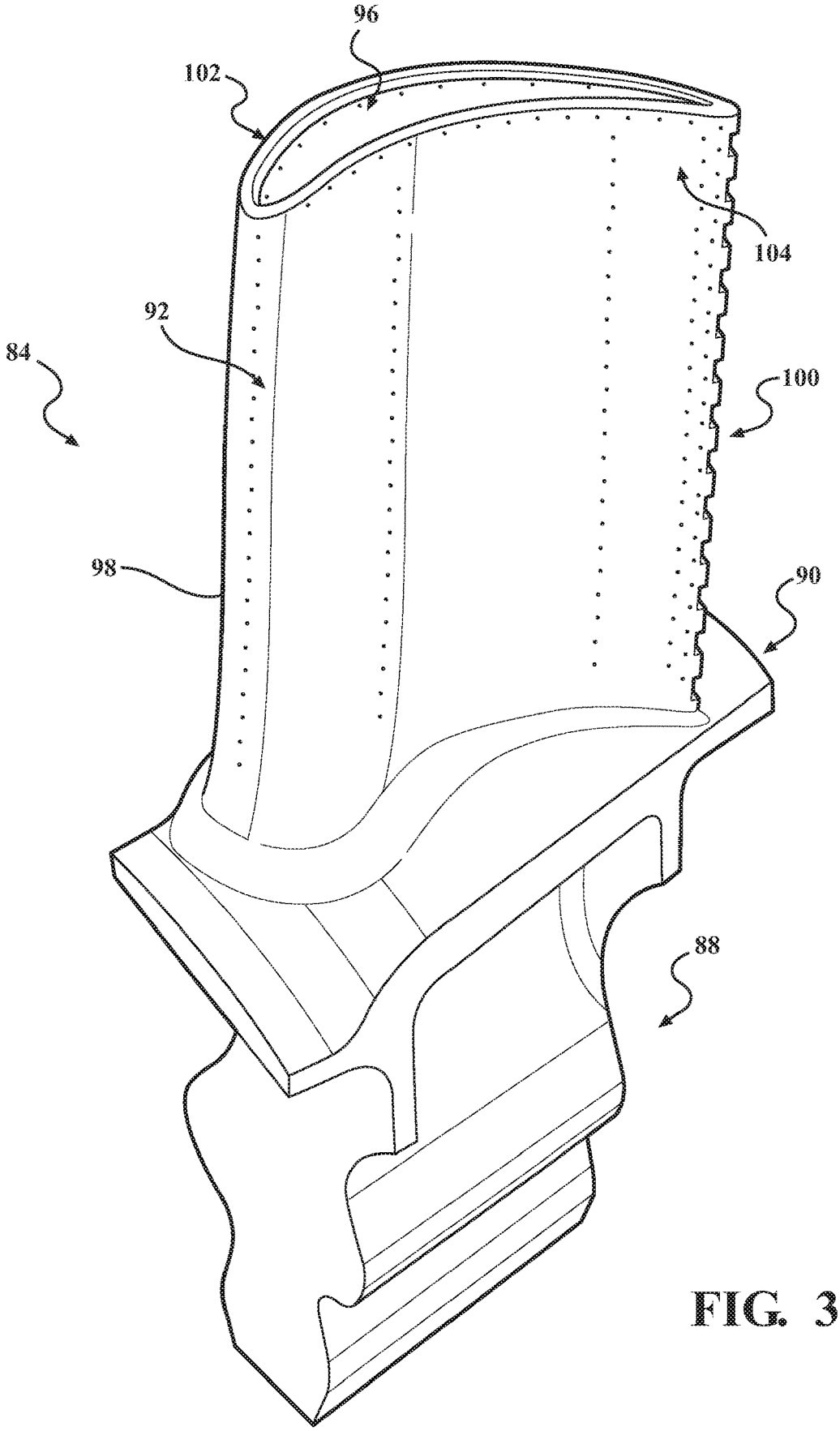
FIG. 3 is a perspective view of an airfoil as an example component such as on an integrally bladed rotor (IBR)

With reference to FIG. 3, the platform 90 generally separates the root 88 and the airfoil 92 to define an inner boundary of a gas path. The airfoil 92 defines a blade chord between a leading edge 98, which may include various forward and/or aft sweep configurations, and a trailing edge 100. A first sidewall 102 that may be convex to define a suction side, and a second sidewall 104 that may be concave to define a pressure side are joined at the leading edge 98 and at the axially spaced trailing edge 100. The tip 96 extends between the sidewalls 102, 104 opposite the platform 90.

Figure 4:
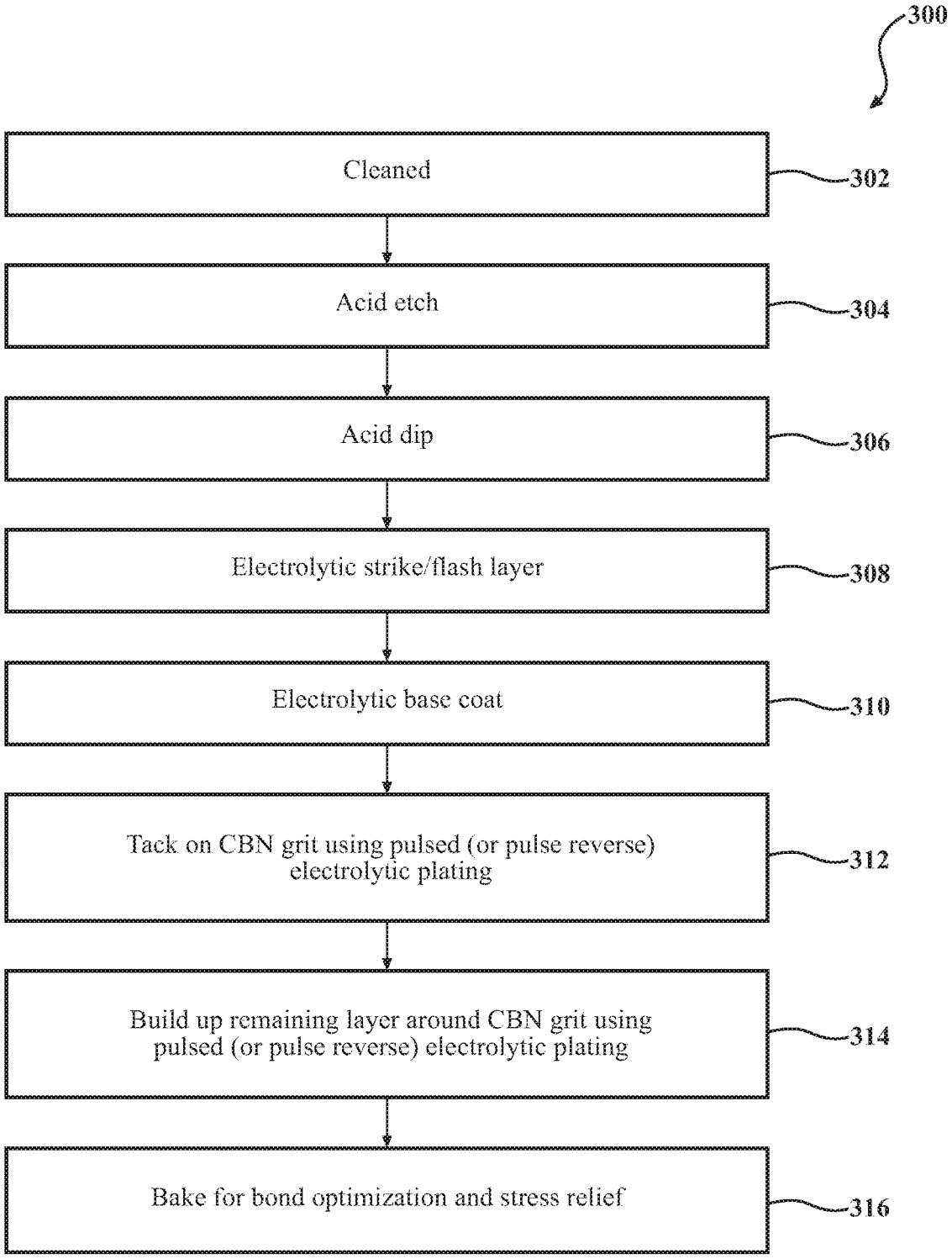
FIG. 4 is a flow chart of a method for applying abrasive grit via pulse plating according to one disclosed non-limiting embodiment.

With reference to FIG. 4, one non-limiting embodiment of a method 300 for applying electroplated coatings such as an abrader 400 is disclosed. The method includes pulse plating of a workpiece, which is here represented as the tip 96 of the airfoil 92. The abrader 400 will rub against the abradable outside air seal and the abrader 400 will thus have a compositions based on, for example, whether the airfoil is used in the cold section, e.g., compressor, or the hot section, e.g., the turbine. It should also be appreciated that application is not limited to aerospace components and various other workpieces for various grinding and/or polishing applications will benefit herefrom.

Figure 7:
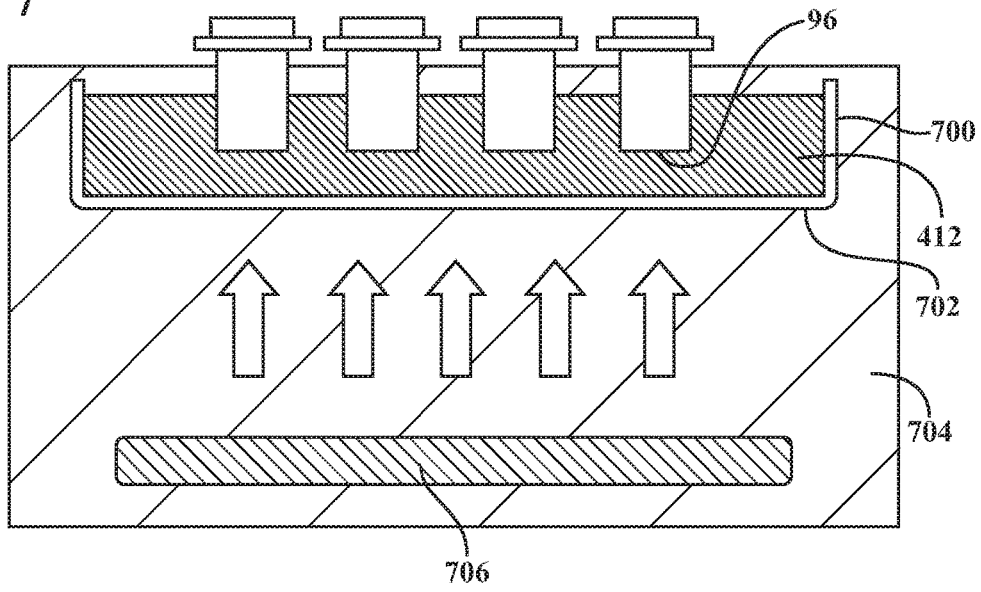
FIG. 7 is a schematic view of a process for formation of a tack layer according to one embodiment.
Figure 8:
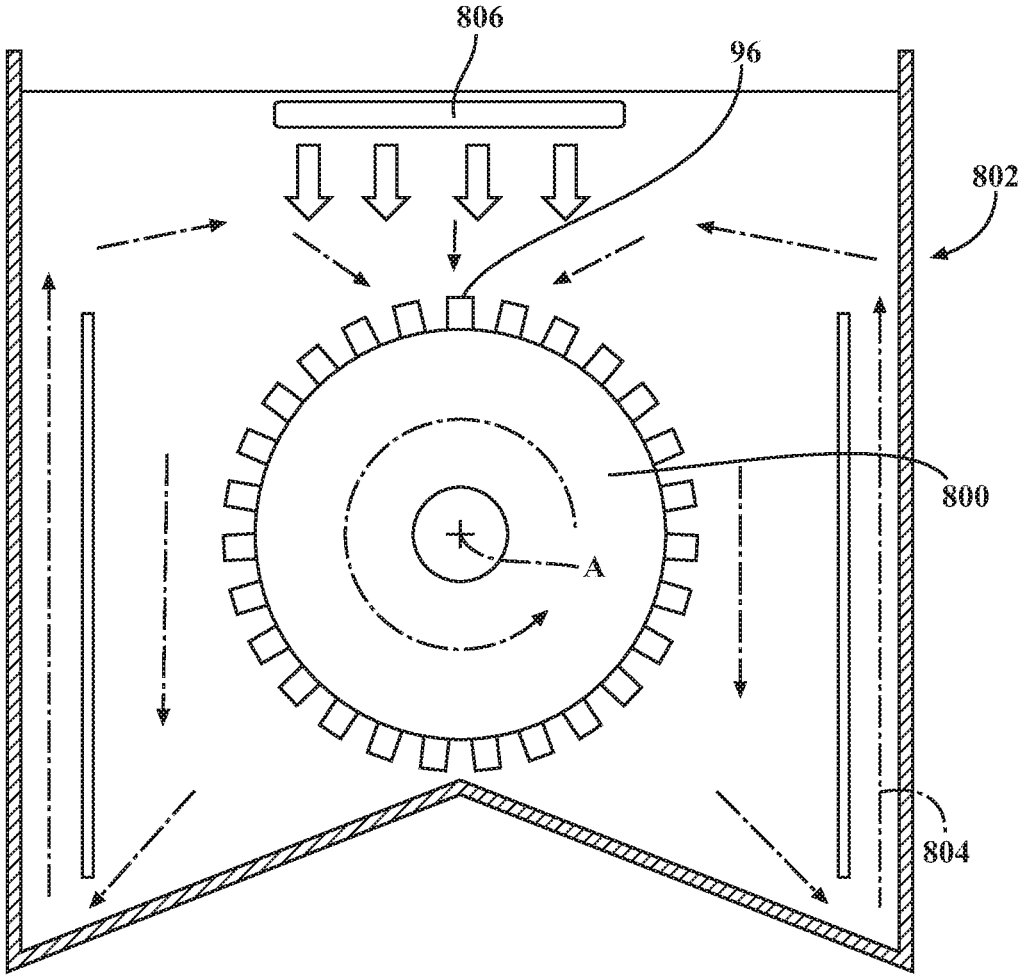
FIG. 8 is a schematic view of a process for formation of a tack layer according to another embodiment.

The method 300 is herein directed to tipping blades in the cold section and need not specifically utilize Ni/Co—Cr—Al—Y/Hf powder or a nickel and/or cobalt (Ni/Co) matrix. The Cr—Al—Y/Hf powder refers to a mixture of chromium, aluminum, yttrium and/or hafnium elements in powder forms that are added into the bath (FIGS. 7 and 8). The powder may alternatively be referred to as CrAlX, where X is yttrium, hafnium, and/or silicon. The final matrix after diffusion heat treat may alternatively be referred to as NiCoCrAlX, where X is yttrium, hafnium, and/or silicon.

The agitation of the plating bath causes the powder to land on the blade tip 96. One example metal is a nickel/cobalt combination. The nickel/cobalt combination is plated at the same time that the Cr—Al—Y/Hf powder is landing on the blade tip, causing the powder to be encapsulated within the plating. When the plating is fully built up, what's left is a matrix 411 surrounding the abrasive grit 412, including the nickel/cobalt metal dispersed with Cr—Al—Y/Hf powder. At that point, the coating is diffusion heat treated, causing the Cr—Al—Y/Hf powder to diffuse into the nickel/cobalt forming a homogenous Ni—Co—Cr—Al—Y/Hf matrix around the abrasive grit 412. Pulse plating can be applied to Ni/Co—Cr—Al—Y/Hf powder or a Ni/Co matrix as well as for the high temperature capability requirements in the hot section as this coating may utilize a Ni/Co—Cr—Al—Y/Hf powder which is pulse plated into the Ni/Co matrix then heat treated to diffuse the Ni/Co—Cr—Al—Y/Hf into the Ni/Co matrix.

In the cold section, for example, the abrader 400 may include a nickel or a nickel-cobalt layer within which is disposed the abrasive grit 412 such as cubic boron nitride (CBN). The nickel or the nickel-cobalt is essentially the matrix 411 in which the abrasive grit 412 is disposed. In the hot section, the abrader 400 may include a nickel or a nickel-cobalt layer that contains the abrasive grit 412 in addition to a Ni/Co—Cr—Al—Y/Hf powder, then be heat treated to diffuse the Ni/Co—Cr—Al—Y/Hf into the nickel or a nickel-cobalt layer.

Pulse plating (FIG. 5B) and/or pulse reverse plating (FIG. 5C) can be utilized in steps 310, 312, and 314, of the method 300 to increase the strength and hardness of the nickel matrix. Pulse plating involves rapidly turning the current on and off. In pulse reverse plating, not only is the current turned off for a short period of time, it is also reversed for a portion of the time (FIG. 5C). This has the effect of repeatedly depositing then removing small amounts of the material in a repetitive fashion.

Figure 5A:
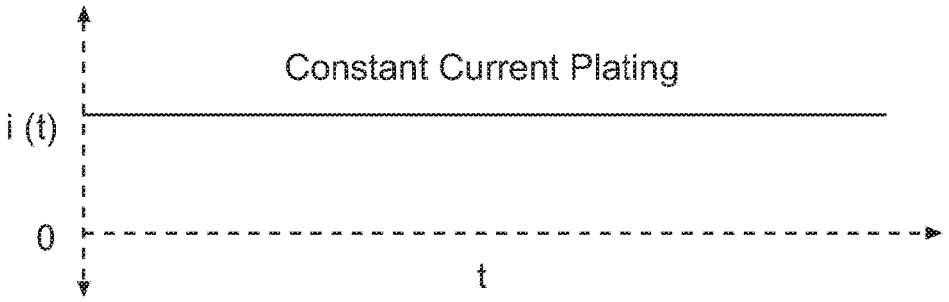
FIG. 5A PRIOR ART
FIG. 5A is a graphical representation of a related art constant current plating diagram.
Figure 5B:
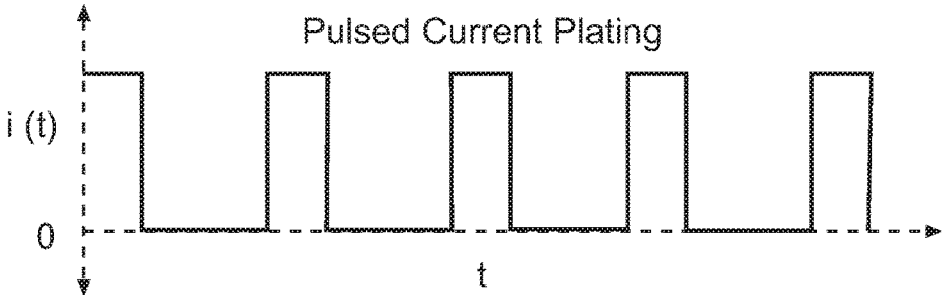
FIG. 5B is a graphical representation of pulsed current plating diagram.
Figure 5C:
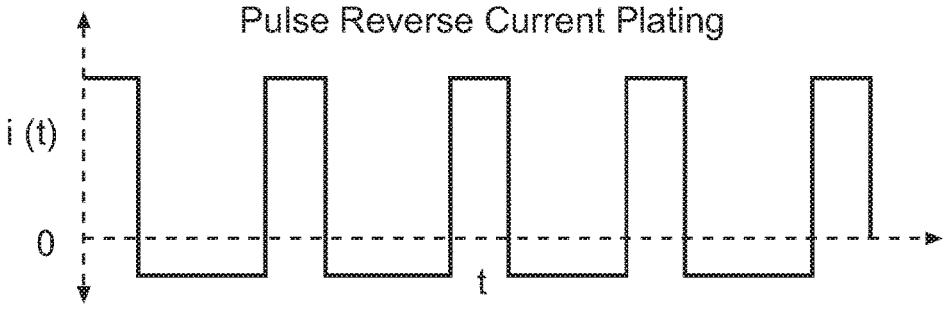
FIG. 5C is a graphical representation of pulse reverse current plating diagram.

FIG. 5A graphically depicts an electrical current versus time plot for constant current plating. In contrast, FIGS. 5B and 5C respectively depict the electric current versus time plot for pulse plating and pulse reverse plating. In pulse plating, the current is turned on and off, and/or can be turned on for a period of time and then reversed for a period of time.

Pulse reverse plating can alternatively or additionally be utilized to facilitate a desired surface finish and/or coating leveling, which refers to a coating's ability to have even distribution over the surface. Electric current is applied during this build-up step while the waveform is varied. That is, instead of using a constant current for the overplating operation, a variety of wave forms, e.g., ramp, step, sinusoidal, etc., may be utilized to rapidly turn off and on the current supply, such that pulsed current plating is effectuated. This builds up the nickel layer matrix 411 around the abrasive grit 412.

Pulsing the current supply causes new nucleation of nickel crystals every time the current is turned on, resulting in a relatively finer grain size, and lower coating porosity. Pulse plating is operable to increase the strength of the nickel or nickel-cobalt matrix. For example, the hardness and fatigue of the abrader 400 produced by the pulse plating method 300 is greater than the hardness and fatigue of the abrader 400 produced by other plating methods that do not involve pulse plating. This increase in hardness and fatigue resistance is primarily due to the reduced grain size of the nickel or nickel-cobalt matrix that occurs during pulse plating as compared with the grain size produced in a matrix having an identical chemical composition during the constant current process (FIG. 5A). In one example, pulse plating can form grains between 10 nanometers and 100 micrometers (the size of direct current plated nickel grains), although in the method 300, particular advantages to reduce coating porosity and increased hardness may arise generally in the 30 to 100 nanometer grain size range.

Figure 6:
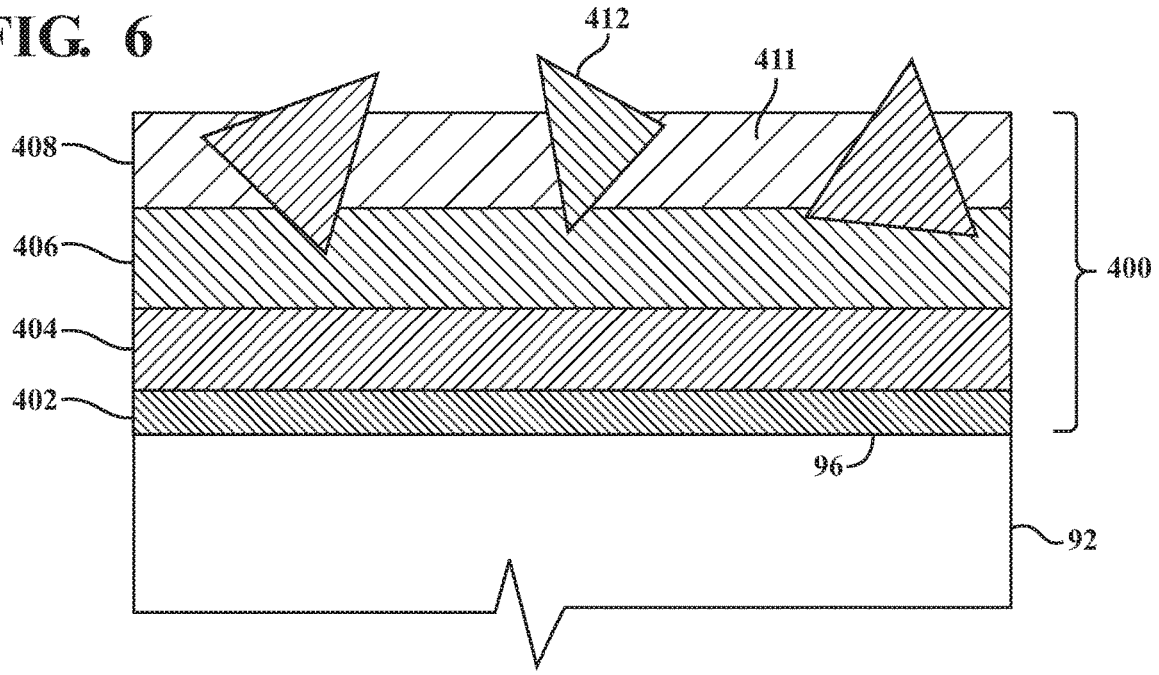
FIG. 6 is a schematic representation of an electroplated coating.

Initially, and with continued reference to FIG. 4, the workpiece is cleaned (Step 302) in preparation for the pulse plating operations. The workpiece, such as the tip 96, may be vapor blasted or otherwise cleaned. The tip 96 may then be etched (Step 304). This may be performed via any suitable etching technique. For example, the etchant used in the anodic etching operation may include hydrochloric acid solution etching solution. An acid dip may then also be performed (Step 306). Various barriers or masks may then be utilized to facilitate containment of the applied electrolytic nickel strike/flash layer 402 (FIG. 6).

Next, the electrolytic nickel strike/flash layer 402 (FIG. 6) is deposited (Step 308). The strike/flash layer 402 in one example may be between about 0.00005-0.001 inches (0.00127-0.00254 mm) thick. The strike/flash layer 402 may be formed via a plating solution 704 that contains a matrix material 411 such as nickel or cobalt to be plated onto the tip 96. In one example, the plating solution utilizes a nickel sulfamate plating bath to apply a pure nickel base layer. The strike/flash layer 402 may, in one example, use a nickel chloride-hydrochloric acid solution that forms the initial bonding layer of nickel plating to the nickel alloy substrate of the example tip 96.

The strike/flash layer 402 is a relatively thin layer whose function is to reduce imperfections in the surface of the tip 96. In the strike/flash layer 402 layer, the tip 96 may be plated in a pulse plating process for a total time period of 1 minute to 10 minutes, or more specifically 2 to 5 minutes. While the strike/flash layer 402 detailed herein includes nickel, the strike/flash layer 402 may also include a combination of nickel and cobalt. The strike/flash layer 402 forms a very strong bond with other nickel plating, and this layer ensures that subsequent plating layers will also have a relatively strong bond to the substrate.

Next an electrolytic base layer 404 (FIG. 6) is formed on the strike/flash layer 402 (Step 310). The base layer 404 in one example may be between about 0.0001-0.0004 inches (0.00254-0.01016 mm) thick. An electric current is utilized to cause a layer of the matrix material 411 to bond to, and thereby plate the tip 96 over the strike/flash layer 402. This step includes a thin layer of nickel plating from a nickel sulfamate plating solution 704, and operates as a base layer to seat the abrasive grit. Oftentimes "bond layer" refers to the base layer of a coating, which allows the rest of the coating to have adhesion, however in this embodiment "bond layer" is a misnomer and the actual bonding layer of this coating method 300 is the strike/flash layer 402.

Next, the matrix material 411, which may be in slurry form, tacks the abrasive grit 412 (FIG. 6) with a pulsed (or pulsed reverse) current plating (Step 312) to form a tack layer 406 (FIG. 6). The nickel or nickel-cobalt matrix of the tack layer 406 provides an anchor for the abrasive grit 412 during deposition. When the tack layer 406 includes nickel alone, the tack layer 406 may be deposited by using an electrolytic cell with nickel sulfamate as the electrolyte. The tack layer 406 in one example may be about 0.002 inches (0.0508 mm) thick.

In one embodiment, a nickel sulfamate plating bath is used to deposit a nickel matrix as the abrasive grit 412 is pressed against the "bond layer" from step 310 (FIGS. 7 and 8). The matrix material 411 builds up to cause the abrasive grit 412 to be "tacked" to the blade tip 96. The nickel or nickel-cobalt matrix of the tack layer 406 essentially provides an anchor for the abrasive grit 412 during deposition. When the tack layer 406 is nickel, the tack layer 406 may be deposited via an electrolytic cell with nickel sulfamate as the electrolyte. That is, the workpiece may be electrically connected via an electrical conductor to a current source so that the tip 96 operates as a cathode. By plating in this manner, the nickel matrix material 411 and the abrasive grit 412 are codeposited onto the tip 96. Once enough nickel has been deposited so as to tack the abrasive grit 412, the workpiece is moved to the overplate step (step 314), which is a final buildup of the nickel matrix around the abrasive grit 412. The abrasive grit 412 may include, for example, cubic boron nitride (CBN) particles having a mesh size of from about 100 to about 120 mesh.

Next, after the co-deposition tacking step is completed, the abrasive grit 412 is further overplated with the matrix material 411 (Step 314) to form an overplate layer 408 (FIG. 6). The overplate layer 408 in one example may be between about 0.003 inches-0.004 0.0762-0.102 mm) thick. The matrix material 411 of the overplate layer 408 is not deposited on top of the abrasive grit 412 because the abrasive grit 412 is non-conductive and therefore does not attract the nickel ions from the plating solution 704. That is, the tip 96 is pulse plated via an electrolytic deposition such that the tip 96 may be subjected to yet another overplating operation in which the workpiece is again placed in a plating bath such as bath containing a fresh supply of plating bath, one without abrasive grit therein, to build up the nickel layer around the abrasive grit.

The overplate layer 408 may include nickel or nickel-cobalt. When the overplate layer 408 utilizes only nickel, it may also be produced in a nickel sulfamate bath by conducting the plating operation for 3 to 4 hours to produce a layer that has a thickness of 75 to 175 micrometers, or more specifically in one example, 90 to 150 micrometers. The total thickness of the nickel or nickel-cobalt layer may be about 100 to 200 micrometers.

Next, a bake for bond optimization and stress relief may be performed (Step 316).

With reference to FIG. 7, in one embodiment, the tack layer 406 may be formed by inserting the workpieces such as blade tips 96 into a basket 700 containing the abrasive grit 412 that is submerged in the plating solution 704. The basket 700 includes a mesh bottom section 702 that permits the plating solution 704 to flow up into the abrasive grit 412. An anode 706 is positioned on the other side of the abrasive grit basket 700 such that current flows through basket 700 and the abrasive grit 412, thence to the workpieces. The abrasive grit 412 is in contact with each blade tip 96 such that the nickel plating forms around the abrasive grit 412 to thereby tack the grit 412 and form the tack layer 406 thereon.

With reference to FIG. 8, in another embodiment, the tack layer 406 may be formed by inserting the workpiece, such as an example integrally bladed rotor (IBR) 800, into a plating bath 802. Air agitation 804 may then be utilized so that the abrasive grit 412 is circulated through bath 802 to cause the abrasive grit 412 to fall down onto each upward facing blade tip 96. An anode 804 may be positioned above blade tips 96 to direct the current down onto blade tip 96 to thereby tack the grit 412 and form the tack layer 406. The workpiece 800 is then rotated so that each blade tip 96 faces upward at some point during processing to be tacked with abrasive grit 412.

In one example, each blade tip 96 may be pulse plating (FIG. 5B) and/or pulse reverse plating (FIG. 5C) via the method 300 to form a surface with the properties shown in Table 1:

| | Pulse Plated Process (For the Nickel Matrix) | | |
|---|---|---|---|
| | Minimum Value (units) | Maximum Value (units) | Average (units) |
| Grain Size | 10 nm | 100 nm | 30 nm |
| Grain Structure | | | Equiaxed, Lamellar |
| Fatigue Strength | | | N/A |
| Elastic modulus | | | N/A |
| Hardness | 250 HV | 400 HV | 300 HV |
| | PRIOR ART-Constant Current Plating Process (For the Nickel Matrix) | | |
| | Minimum Value (units) | Maximum Value (units) | Average (units) |
| Grain Structure | | | Columnar |
| Grain Size | 600 nm | 1500 nm | 1000 nm |
| Fatigue Strength | | | N/A |
| Elastic modulus | | | N/A |
| Hardness | 170 HV | 230 HV | 200 HV |

In this example, the blade tip 96 has the abrader 400 that includes a grit with a grain size between 10-100 nm and a hardness between 250-400 HV.

Pulse plating for electroplated abrasive coatings can provide a relatively finer grain size on the scale of tens of nanometers per grain, reduced coating porosity, and increased hardness. According to the Hall-Petch relation, materials with smaller grain sizes generally benefit from grain-boundary strengthening, which increases the coating's fatigue strength, and also the fatigue life of the entire airfoil. Reduced coating porosity and increased hardness improves the wear resistance of the coating, and therefore the coating's durability and life. This reduces the frequency of required repair and overhaul of these coatings, which saves money and time. Additionally, pulse plating has been shown to improve the uniformity of the coating, as far as plating thickness and distribution, which could positively affect the overall quality of the coating and reduce production defects. Furthermore, pulse plating could also allow for higher currents to be utilized when depositing the coating, which would allow for the coating to be applied faster and thereby increasing production rate.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A method for forming an abrasive surface on a tip of a rotor blade, comprising:

applying an electroplated strike/flash layer on the tip of the rotor blade via a plating solution that contains a matrix material, the electroplated strike/flash layer facilitating bonding of subsequent plating layers, the electroplated strike/flash layer between about 0.00005-0.001 inches (0.00127-0.0254 mm) thick, the rotor blade is one of a multiple of rotor blades that extend from an integrally bladed rotor (IBR) workpiece;

applying an electroplated electrolytic base layer on the strike/flash layer, the electrolytic base layer is between 0.0001-0.0004 inches (0.00254-0.01016 mm) thick;

placing the rotor blade in a first plating bath containing a plating solution and an abrasive grit therein then submerging the basket in the plating solution, the basket comprising a mesh bottom section that permits the plating solution to flow up into the abrasive grit;

flowing current through the basket and the abrasive grit, thence the blade tip, the abrasive grit in contact with the blade tip such that the nickel plating forms around the abrasive grit forming an electroplated tack layer on the electroplated electrolytic base layer by pulse plating within the first plating bath with a step wave waveform causing codeposition of a nickel layer matrix material and an abrasive grit onto the tip until the abrasive grit is tacked to the electroplated electrolytic base layer, the electroplated tack layer is 0.002 inches (0.0508 mm) thick;

placing the tip of the rotor blade in a second plating bath containing a fresh supply of plating solution without an abrasive grit therein;

applying an electroplated overplate layer on the electroplated tack layer by pulse plating within the second plating bath with a step wave waveform causing new nucleation of nickel crystals every time the current is turned on thereby building up a nickel layer matrix material with a grain size between 10-100 nm and a hardness between 250-400HV around the abrasive grit, the nickel layer matrix material of the overplate layer not building up over the abrasive grit because the abrasive grit is non-conductive and does not attract nickel ions from the plating solution, the electroplated overplate layer is between 0.003-0.004 inches (0.0762-0.102 mm) thick.

2. The method as recited in claim 1, wherein applying the electroplated strike/flash layer comprises pulse plating for a total time period of 1 to 10 minutes.

3. The method as recited in claim 2, wherein applying the electroplated overplate layer comprises pulse plating for a total time period of for 3 to 4 hours.

4. The method as recited in claim 1, wherein applying the electroplated strike/flash layer on the tip of the rotor blade comprises reducing imperfections in the surface of the tip via a plating solution.

5. A method for forming an abrasive surface on a tip of a rotor blade, comprising:

applying an electroplated strike/flash layer on the tip of the rotor blade via a plating solution that contains a matrix material reducing imperfections in the surface of the tip, the electroplated strike/flash layer facilitating bonding of subsequent plating layers, wherein applying the electroplated strike/flash layer comprises pulse plating for a total time period of 1 to 10 minutes, the rotor blade is one of a multiple of rotor blades that extend from an integrally bladed rotor (IBR) workpiece;

applying an electroplated electrolytic base layer on the strike/flash layer;

placing the rotor blade in a first plating bath containing a plating solution and an abrasive grit therein, the first plating bath comprises placing the rotor blade into a basket containing the abrasive grit and submerging the basket in the plating solution, then flowing current through the basket and the abrasive grit, thence the blade tip, the basket comprising a mesh bottom section that permits the plating solution to flow up into the abrasive grit the abrasive grit in contact with the blade tip such that an electroplated tack layer formed thereby tacks the grit on the electroplated electrolytic base layer by pulse plating within the first plating bath with a step wave waveform, the step wave waveform causing codeposition of a nickel layer matrix material and an abrasive grit onto the tip until the abrasive grit is tacked to the electroplated electrolytic base layer; and placing the tip of the rotor blade in a second plating bath containing a fresh supply of plating solution without an abrasive grit therein forming an electroplated overplate layer on the electroplated tack layer by pulse plating within the second plating bath with a step wave waveform causing nucleation of nickel crystals every time the current is turned on thereby building up a nickel layer matrix material with a grain size between 10-100 nm and a hardness between 250-400HV around the abrasive grit, the nickel layer matrix material of the overplate layer not building up over the abrasive grit because the abrasive grit is non-conductive and does not attract nickel ions from the plating solution, wherein applying the electroplated overplate layer comprises pulse plating for a total time period of for 3 to 4 hours, the resultant electroplated strike/flash layer between about 0.00005-0.001 inches (0.00127-0.0254 mm) thick, the electrolytic base layer is between 0.0001-0.0004 inches (0.00254-0.01016 mm) thick, the electroplated tack layer is 0.002 inches (0.0508 mm) thick, and the electroplated overplate layer between 0.003-0.004 inches (0.0762-0.102 mm) thick.

6. A method for forming an abrasive surface on a tip of a rotor blade, comprising:

applying an electroplated strike/flash layer on the tip of the rotor blade via a plating solution that contains a matrix material, the electroplated strike/flash layer facilitating bonding of subsequent plating layers, the electroplated strike/flash layer between about 0.00005-0.001 inches (0.00127-0.0254 mm) thick, the rotor blade is one of a multiple of rotor blades that extend from an integrally bladed rotor (IBR) workpiece;

applying an electroplated electrolytic base layer on the strike/flash layer, the electrolytic base layer is between 0.0001-0.0004 inches (0.00254-0.01016 mm) thick;

placing the rotor blade in a first plating bath containing a plating solution and an abrasive grit therein wherein placing the rotor blade in the first plating bath comprises rotating a workpiece with the rotor blade so that each blade tip of each rotor blade faces upward at during processing to be tacked with the abrasive grit, the abrasive grit in contact with the blade tip such that the nickel plating forms around the abrasive grit forming an electroplated tack layer on the electroplated electrolytic base layer by pulse plating within the first plating bath with a step wave waveform causing codeposition of a nickel layer matrix material and an abrasive grit onto the tip until the abrasive grit is tacked to the electroplated electrolytic base layer, the electroplated tack layer is 0.002 inches (0.0508 mm) thick, an anode positioned above the blade tip to direct the current down onto the blade tip to tack the abrasive grit and form the tack layer;

using air agitation so that the abrasive grit is circulated through the first bath to cause the abrasive grit to fall down onto each upward facing blade tip;

placing the tip of the rotor blade in a second plating bath containing a fresh supply of plating solution without an abrasive grit therein; and applying an electroplated overplate layer on the electroplated tack layer by pulse plating within the second plating bath with a step wave waveform causing new nucleation of nickel crystals every time the current is turned on thereby building up a nickel layer matrix material with a grain size between 10-100 nm and a hardness between 250-400HV around the abrasive grit, the nickel layer matrix material of the overplate layer not building up over the abrasive grit because the abrasive grit is non-conductive and does not attract nickel ions from the plating solution, the electroplated overplate layer is between 0.003-0.004 inches (0.0762-0.102 mm) thick.

7. The method as recited in claim 1, wherein the plating solution that contains the matrix material for applying the electroplated strike/flash layer on the tip of the rotor blade comprises a nickel sulfamate plating bath.

* * * * *